US006408593B1

(12) United States Patent
Foster et al.

(10) Patent No.: US 6,408,593 B1
(45) **Date of Patent: *Jun. 25, 2002**

(54) SHINGLE COMPOSITION

(76) Inventors: Pete Foster; Donald E. Dilks, both of 7017 Manor, Ft. Worth, TX (US) 76180

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/387,484

(22) Filed: Sep. 1, 1999

(51) Int. Cl.[7] ..... E04D 1/20; C08L 9/06

(52) U.S. Cl. ..... 52/748.1; 521/139; 521/140; 525/93; 525/98; 525/221; 525/222; 525/227; 525/232

(58) Field of Search ..... 525/222, 93, 98, 525/221, 227, 232; 521/139, 140; 52/518, 748.1

(56) References Cited

U.S. PATENT DOCUMENTS 3,424,649 A * 1/1969 Nyberg
4,226,950 A 10/1980 Holub et al. ..... 525/67
4,329,309 A * 5/1982 Kelly
4,596,684 A * 6/1986 Kumasaka
4,877,827 A 10/1989 Van Der Groep ..... 524/477
4,997,880 A 3/1991 Van Der Groep ..... 525/57
5,198,496 A * 3/1993 Alvarez
5,623,802 A 4/1997 Boushek et al. ..... 52/543
5,717,020 A 2/1998 Kopytko ..... 524/425
5,728,741 A 3/1998 Zegler et al. ..... 521/40
5,733,980 A 3/1998 Cozewith et al. ..... 525/314

FOREIGN PATENT DOCUMENTS

AU 80902 * 4/1999

* cited by examiner

*Primary Examiner*—David J. Buttner
(74) *Attorney, Agent, or Firm*—Bracewell & Patterson, LLP

(57) ABSTRACT

A polymeric roofing shingle composition is shown which includes (a) a rubber component present in the range from about 10–95% by weight, based on the total weight of the composition and (b) a polyolefin component present in the range from about 5–50% by weight, based on the total weight of the composition. A SBR/EVA closed cell rubber composition can be formulated which has a weight of less than 150 pounds per roofing square for ⅛ inch thickness and which is flame retardant at thicknesses of ⅛ inch and higher without the addition of separate flame retardant components.

4 Claims, 1 Drawing Sheet

SHINGLE COMPOSITION

BACKGROUND OF THE INVENTION

1. Field of the Invention

This invention relates generally to roofing and construction technology and, specifically, to new roofing shingles formed from polymeric compositions.

2. Description of the Prior Art

Conventional asphalt shingles are widely used in the construction and roofing industries at the present time. These materials are typically formed of a lower layer of asphalt, an intermediate layer of base made from either fiberglass or felt, an upper layer of asphalt, and a layer of weather resistant granules. The felt is usually impregnated with the asphalt from the upper and lower layers. The voids between the individual fibers of glass in the fiberglass are usually occupied by asphalt from the upper and lower layers, which also coats the fibers. The shingles can be attached to the roof by conventional means, including nails or staples.

In production, conventional asphalt composite shingles are made in a hot asphalt coating process as a continuous sheet of composite material with the width being dictated by the design of the coating equipment. The sheet is fed into a cutting device which cuts individual shingles from the sheet. As mentioned, the exposed, outer surface of the asphalt shingle is generally provided with a covering of granular material embedded within the coating of asphalt. The granular material generally protects the underlying asphalt coating from damage due to exposure to the light, particularly ultraviolet light. The granules reflect light and protect the asphalt from deterioration in the sun. In addition, such granular material improves fire resistance and weathering characteristics. Further, colors or mixtures of colors of granular material may be selected for aesthetics.

Generally, the mineral materials, particles or granules are embedded within the coating of asphalt under pressure and are retained therein by adherence to the asphalt. Granule loss can occur due to many factors, such as aging or physical abrasion, as when a person walks on the roof. Loss of the granules reduces the life of the traditional composition shingle roof. In addition, the aesthetics of the roofing system may be compromised if granules are lost. Further, reduction of fire retardancy, and hence safety conditions of the roof may be compromised.

In addition to granule loss and deterioration, the prior art composition shingles were relatively heavy, as compared to, for example, synthetic materials of the same square area and thickness.

A need exists therefore for an improved roofing shingle which overcomes the prior art problems of deterioration, granule loss and loss of fire retardancy.

A need exists for such a roofing shingle made from a polymeric composition, rather than from asphalt based materials, which eliminates the need for incorporation of granules into the formulation.

A need also exists for such an improved shingle made from a polymeric composition which is lighter in weight per roofing square than the prior art asphalt composition roof shingles.

A need also exists for such an improved roofing shingle which exhibits adequate fire retardancy without the necessity of incorporating additional fire retardant ingredients, coatings or agents into the polymeric formulation.

SUMMARY OF THE INVENTION

The present invention comprises a shingle composition for the roof of a structure. The improved composition comprises:

(a) a rubber component present in the range from about 5–95% by weight, based on the total weight of the composition;

(b) a polyolefin component present in the range from about 5–70% by weight, based on the total weight of the composition;and wherein the shingle composition is further characterized as having a weight of less than 150 pounds per roofing square at ⅛ inch thickness and which meets the flame retardancy requirements of FMVSS-302 at thicknesses of ⅛ inch and higher without the addition of separate flame retardant components.

Preferably, the shingle composition comprises:

(a) an styrene-butadiene copolymer rubber component present in the range from about 10–95% by weight, based on the total weight of the composition;

(b) an ethylene vinyl acetate copolymer component present in the range from about 5–50% by weight, based on the total weight of the composition.

A particularly preferred shingle composition is further characterized as having a Shore A hardness as measured by ASTM D 2240 of approximately 70, a density as measured by ASTM D 3575 of approximately 22.5 pounds per foot and a tensile strength as measured by ASTM D 412 of approximately 270 psi. The preferred shingle composition has a minimum elongation as measured by ASTM D 412 of approximately 200% and a resilience as measured by ASTM D 2632 of approximately 34%.

Additional objects, features and advantages will be apparent in the written description which follows.

DETAILED DESCRIPTION OF THE INVENTION

Figure 1:
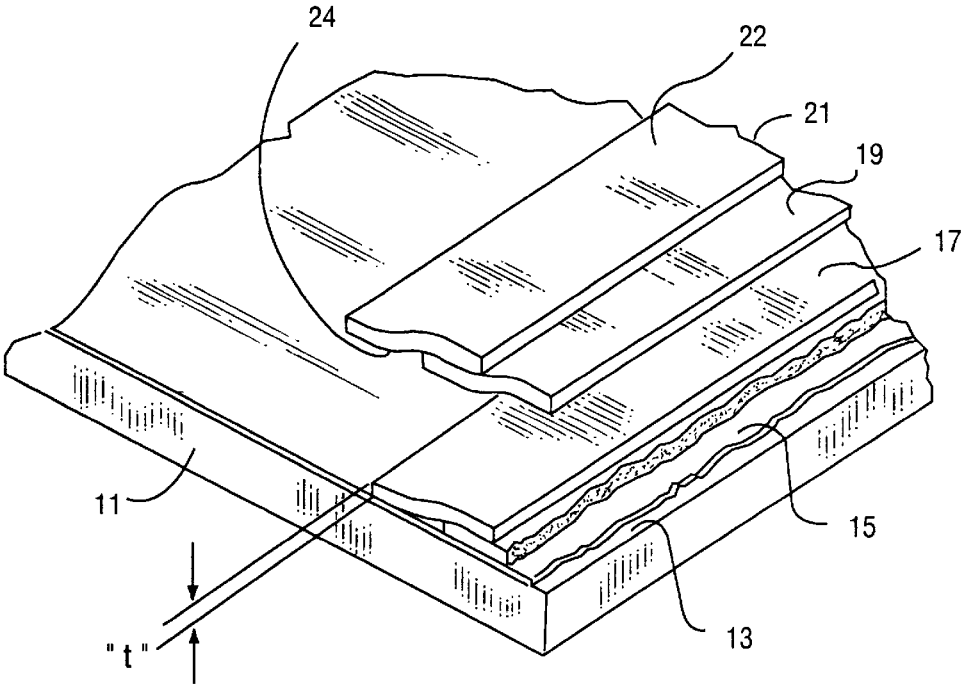
FIG. 1 is a perspective view, partially broken away, of a roof of a structure showing the roofing shingles of the invention being applied to the roof.

Turning to FIG. 1 of the drawings, there is shown a typical roof 11 of a structure. The roof 11 has upper decking 13, typically of plywood, and roll roofing material 15 covering the decking. Successive layers of shingles, 17, 19, 21 are applied, as by nailing or gluing to the roof substrate. In some cases, it may not be necessary to utilize the roll roofing material. Each shingle 21 has an upper planar surface 22, a lower planar surface 24 and a thickness "t".

The shingle compositions of the invention are formed of a "polymeric" material, rather than being formed of traditional asphalt composition material. By "polymeric" is meant that the shingle compositions of the invention are of a rubber-like, plastic, or synthetic resin type nature as opposed to the traditional asphalt based compositions described in the above prior art description.

The improved shingle compositions of the invention comprise:

(a) a rubber component present in the range from about 5–95% by weight, based on the total weight of the composition;and (b) a polyolefin component present in the range from about 5–70% by weight, based on the total weight of the composition.

The rubber component of the compositions of the invention can include, for example, styrene butadiene rubber, butadiene acrylonitrile rubber, SBS, polybutadiene rubber, butyl rubber, chlorobutyl rubber, polyiosprene, chloroprene rubber and the like, including mixtures or blends thereof.

The preferred rubber component is a styrene butadiene rubber (SBR) present in the range from about 5–95% by weight, preferably about 10–70% by weight, based on the total weight of the composition. The rubber can be a random butadiene-styrene copolymer, a block butadiene-styrene copolymer, or mixtures thereof.

Hydrogenated random butadiene-styrene copolymers can be prepared by any of the conventional techniques known in the art, for example those taught in U.S. Pat. No. 2,975,160, to Zelinski, issued Mar. 14, 1961. For example, a mixture of butadiene and styrene monomers can be polymerized using butyllithium as a catalyst, and tetrahydrofuran as a randomizing agent. The hydrogenation can be carried out in any manner known in the art, such as the process taught by U.S. Pat. No. 2,864,809, to Jones, issued Dec. 16, 1968.

Suitable block copolymers are copolymers of butadiene and styrene having several polybutadiene chains extending from a central link with a polystyrene block attached to the outward end of each polybutadiene segment. The block copolymers can be prepared by any of the conventional techniques, such as those described in U.S. Pat. No. 3,251, 905, to Zelinski, issued May 17, 1966. The rubber component can also be a mixture of random and block copolymers of the type described above.

The improved roof shingle compositions of the invention also include as one component a polyolefin component. The term "polyolefin" is intended to include those formed by homopolymerization of ethylene monomers or copolymerization of ethylene monomers with other monomers. Such polyolefins are generally referred to as ethylenic polyolefins. Polyethylene itself is one example. Also embraced within the term are ethylene acrylic acid copolymers, ethylene acrylate copolymers, ethylene vinyl acetate copolymers, and various other copolymers or terpolymers with an ethylene content. A preferred polyolefin component of the compositions is an ethylene vinyl acetate copolymer.

The ethylene vinyl acetate copolymer is commercially available in a variety of formulations. Available formulations have a vinyl acetate content ranging from about 15 to 45% based upon total monomers. Preferred formulations have vinyl acetate contents in the range of about 30–40 weight %. The ethylene vinyl acetate copolymer component of the shingle composition of the invention is present in the range from about 5–70% by weight, preferably from about 5–50% by weight, based upon the total weight of the composition, most preferably about 10–40% by weight.

The compositions of the invention can also contain traditional additives for rubber and plastic type polymeric compositions such as fillers and coloring agents. A variety of stabilizers and fillers are known in the art and include, for example, silica, talc, micaceous materials, dolomite, various minerals and inorganic salts or oxides or flakes. Coloring agents, such as iron oxide, carbon black, and the like, may also be employed. These traditional additives are utilized in conventional systems and may be used in the improved compositions of the invention in the same manner.

A commercially available composition useful to manufacture the roofing shingles of the invention is the Monarch Rubber Co., "Midflex #560" product which is a SBR/EVA blended 22.5 pound per cubic foot density, closed cell rubber product. The product does not incorporate a flame retardant but meets FMSS-302 at thicknesses of ⅛ inch and above.

Roofing shingles, for example ⅛ inch thick, made from the above material have a weight of less than 150 pounds per roofing square, preferably less than 130 pounds per roofing square, a significant advantage over the prior art asphalt composition shingles which typically have a weight of 185 pounds per square for the equivalent thickness. Since the materials are generally flame retardant without the addition of separate flame retardant components, they do not suffer from the deficiencies noted with respect to the granular, asphalt based composition shingles.

The roofing shingles of the invention are also further characterized as having a Shore A Hardness as measured by ASTM D 2240 of approximately 70, a density as measured by ASTM D 3575 of approximately 22.5 pounds per foot and a tensile strength as measured by ASTM D 412 of approximately 270 psi. The shingles also have a minimum elongation as measured by ASTM D 412 of approximately 200% and a resilience as measured by ASTM D 2632 of approximately 34%. The shingles have a C-Tear strength of approximately 70 pounds per inch as measured by ASTM D 624.

In weight comparison tests, the ⅛ inch thick roofing shingles of the invention were 56.70 pounds lighter per roofing square and 18.90 pounds lighter per bundle than typical asphalt composition roofing shingles of the same thickness. A typical asphalt composition shingle weighed 2.30 pounds as compared to the 1.60 pound shingle of the invention.

The roofing shingles of the invention can be installed on a roof in the traditional manner by properly locating the shingle on a layer of roll roofing and either nailing or stapling the shingle in place. Because the shingles are formed of a polymeric material, they can also be glued in place with a suitable glue or adhesive which is selected so as to be compatible with the polymeric nature of the shingle composition. Thus, a glue or adhesive will typically be applied at the contact areas between the upper and lower planar surfaces (22, 24 in FIG. 1) of adjacent shingles during the installation process. Whether or not the shingles are nailed in place, the application of a suitable adhesive to the contacting surfaces of the shingles provides a more water tight and water resistant roof covering.

Figure 2:
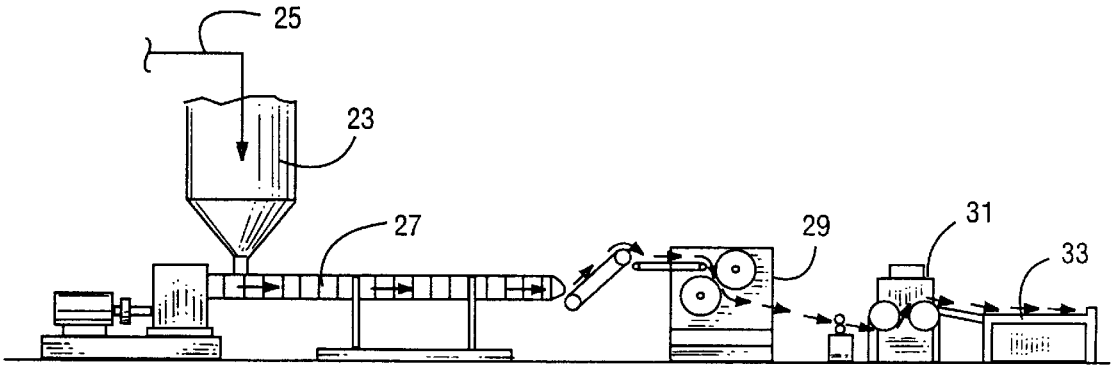
FIG. 2 is a diagrammatic side view of a process used to manufacture the roofing shingles of the invention.

FIG. 2 of the drawings shows a typical manufacturing process for manufacturing the roofing shingles of the invention in simplified fashion. The rubber component and polyolefin component are added to a feed bin 23 through chute 25. The components are fed to a heated extruder 27 where they are heated and blended by an auger. The extruded material is fed in sheet form to a calander, from which it exits as a sheet of desired thickness and width. The sheet is then passed through cutting station 31 where it exits to conveyor 33 as shingle width and length material.

An invention has been provided with several advantages. The roofing shingles of the invention are formed from a polymeric composition which is lighter in weight than traditional asphalt based composition shingles. The lighter weight makes the shingles easier to transport and use. The shingles are fire retardant without the necessity of adding fire retardant agents which might be worn away or dissipated as was the case with granule based retardants used in traditional asphalt based shingles. Since the shingles are formed of a polymeric, synthetic material, they can be manufactured by a simplified process which generally only involves blending the constituent components in a hopper or extruder and extruding the sheet material. The single layer or homogeneous nature of the shingles of the invention is simpler to manufacture than the prior art asphalt composition shingles which generally involved multiple layers of diverse materials.

While the invention has been shown in only one of its forms, it is not thus limited but is susceptible to various changes and modifications without departing from the spirit thereof.

What is claimed is:

1. A method of roofing a structure, the method comprising the steps of:

providing a shingle for the roof of the structure, the shingle composition comprising:

(a) a styrene-butadiene copolymer rubber component present in the range from about 5–95% by weight, based on the total weight of the composition;

(b) an ethylenic polyolefin component selected from the group consisting of polyethylene, ethylene acrylic acid copolymers, ethylene acrylate copolymers and ethylene vinyl acetate copolymers, the ethylenic polyolefin component being present in the range from about 5–50% by weight, based on the total weight of the composition;

wherein the shingle composition is further characterized as having a weight of less than 150 pounds per roofing square for ⅛ inch thickness, which meets the flame retardancy requirements of FMVSS-302 at thicknesses of ⅛ inch thickness and higher without the addition of separate flame retardant components ,and wherein the shingle composition is further characterized by the absence of an asphaltine constituent ;and installing the shingle on the roof of the structure.

2. A method of roofing a structure, the method comprising the steps of:

providing a shingle for the roof of the structure, the shingle composition consisting essentially of:

(a) an styrene-butadiene copolymer rubber component present in the range from about 5–95% by weight, based on the total weight of the composition;

(b) an ethylene vinyl acetate copolymer component present in the range from about 5–50% by weight, based on the total weight of the composition;

wherein the shingle composition is further characterized as having a weight of less than 150 pounds per roofing square for ⅛ inch thickness, which meets the flame retardancy requirements of FMVSS-302 at thicknesses of ⅛ inch thickness and higher without the addition of separate flame retardant components ,and wherein the shingle composition is further characterized by the absence of an asphaltine constituent ;and installing the shingle on the roof of the structure.

3. The method of claim 2, wherein the shingle composition has a hardness as measured by ASTM D 2240 of approximately 70, a density as measured by ASTM D 3575 of approximately 22.5 pounds per foot and a tensile strength as measured by ASTM D 412 of approximately 270 psi.

4. The method of claim 3, further characterized as having a minimum elongation as measured by ASTM D 412 of approximately 200% and a resilience as measured by ASTM D 2632 of approximately 34%.

* * * * *